US011845049B2

(12) United States Patent
Piepereit

(10) Patent No.: US 11,845,049 B2
(45) Date of Patent: Dec. 19, 2023

(54) APPARATUS FOR MIXING INCLUDING A LIQUID INJECTION NOZZLE

(71) Applicant: MATCON LTD, Evesham (GB)

(72) Inventor: Edward J. Piepereit, Stow-on-the-Wold (GB)

(73) Assignee: MATCON LTD, Evesham (GB)

( * ) Notice: Subject to any disclaimer, the term of this patent is extended or adjusted under 35 U.S.C. 154(b) by 406 days.

(21) Appl. No.: 16/472,653

(22) PCT Filed: Dec. 21, 2017

(86) PCT No.: PCT/GB2017/053870
§ 371 (c)(1),
(2) Date: Jun. 21, 2019

(87) PCT Pub. No.: WO2018/115893
PCT Pub. Date: Jun. 28, 2018

(65) Prior Publication Data

US 2019/0358599 A1 Nov. 28, 2019

(30) Foreign Application Priority Data

Dec. 23, 2016 (GB) ..... 1622183

(51) Int. Cl.
*B01F 29/60* (2022.01)
*B01F 23/53* (2022.01)
(Continued)

(52) U.S. Cl.
CPC ..... *B01F 29/61* (2022.01); *B01F 23/53* (2022.01); *B01F 23/59* (2022.01); *B01F 29/32* (2022.01);
(Continued)

(58) Field of Classification Search
CPC ..... B01F 3/12; B01F 3/1221; B01F 3/1271; B01F 2003/1257; B01F 9/025;
(Continued)

(56) References Cited

U.S. PATENT DOCUMENTS 856,859 A * 6/1907 Gentieu ..... B29B 7/7663 366/159.1
2,915,300 A * 12/1959 Fischer ..... B01F 29/40118 366/170.2
(Continued)

FOREIGN PATENT DOCUMENTS

CN 203043901 U 7/2013
CN 203790906 U * 8/2014
(Continued)

OTHER PUBLICATIONS

Saenger Bernhard, Translated Patent Application of DE102004014340A1 (Year: 2005).*
(Continued)

*Primary Examiner* — Charles Cooley
(74) *Attorney, Agent, or Firm* — Morgan, Lewis & Bockius LLP

(57) ABSTRACT

An apparatus for mixing a particulate material with a liquid in a container is adapted for tumble blending. The apparatus comprises a mixing device and a liquid injection nozzle. The mixing device includes mixer elements adapted to mix a particulate material by mechanical action. The nozzle is disposed to direct liquid in the direction of the mixer elements when mixing is taking place and ingress of material is prevented from entering into the nozzle.

10 Claims, 10 Drawing Sheets

(51) Int. Cl.

| | |
|---|---|
| ***B01F 23/50*** | (2022.01) |
| ***B01F 29/32*** | (2022.01) |
| ***B01F 29/64*** | (2022.01) |
| ***B01F 35/21*** | (2022.01) |
| ***B01F 35/221*** | (2022.01) |
| ***B01F 101/06*** | (2022.01) |
| ***B01F 101/22*** | (2022.01) |

(52) U.S. Cl.
CPC ..... *B01F 29/64* (2022.01); *B01F 35/211* (2022.01); *B01F 35/22162* (2022.01); *B01F 23/565* (2022.01); *B01F 2101/06* (2022.01); *B01F 2101/22* (2022.01)

(58) Field of Classification Search
CPC .... B01F 9/0018; B01F 9/08; B01F 15/00129; B01F 15/00415; B01F 2215/0014; B01F 2215/0032; B01F 2101/06; B01F 2101/22; B01F 23/50; B01F 23/53; B01F 23/565; B01F 23/59; B01F 29/32; B01F 29/61; B01F 29/64; B01F 35/211; B01F 35/22162
USPC ..... 366/172.2, 175.3, 287
See application file for complete search history.

(56) References Cited

U.S. PATENT DOCUMENTS

| | | | | | |
|---|---|---|---|---|---|
| 5,054,933 | A * | 10/1991 | Derksen | B01F 27/808 | 366/138 |
| 5,061,456 | A * | 10/1991 | Brazelton | B01F 23/43 | 422/135 |
| 5,603,567 | A * | 2/1997 | Peacock | B01F 33/70 | 366/147 |
| 5,865,538 | A * | 2/1999 | Walker | B01F 29/64 | 366/209 |
| 6,599,005 | B2 * | 7/2003 | Van Der Wel | B01F 27/806 | 366/326.1 |
| 2003/0185094 | A1 * | 10/2003 | Packard | B29B 7/28 | 366/141 |
| 2005/0190646 | A1 * | 9/2005 | Grandjean | B01F 27/95 | 366/287 |
| 2012/0287747 | A1 * | 11/2012 | Lee | B01F 27/0724 | 366/209 |
| 2016/0230890 | A1 * | 8/2016 | Piepereit | F16J 15/16 | |
| 2017/0246604 | A1 * | 8/2017 | Sollazzo Lee | B01F 27/88 | |
| 2019/0118149 | A1 * | 4/2019 | Alexander | B01F 29/252 | |
| 2019/0254465 | A1 * | 8/2019 | Di Maria | B01F 29/34 | |
| 2019/0358599 | A1 * | 11/2019 | Piepereit | B01F 23/50 | |
| 2019/0381468 | A1 * | 12/2019 | Djupevåg | B01F 29/61 | |

FOREIGN PATENT DOCUMENTS

| | | | |
|---|---|---|---|
| CN | 203790906 | U | 8/2014 |
| DE | 1507894 | A1 | 4/1939 |
| DE | 1507894 | A1 | 4/1969 |
| DE | 102004014340 | A1 | 10/2005 |
| EP | 2386351 | A2 | 11/2011 |
| GB | 549250 | A | 11/1942 |
| GB | 2548386 | A | 9/2017 |
| JP | S61-106959 | A | 5/1986 |
| JP | S61-106959 | A | 1/1988 |

OTHER PUBLICATIONS

Mou Yongcheng, Translated Patent Application of CN203790906U (Year: 2014).*
International Search Report for International Application No. PCT/GB2017/053870 dated Apr. 24, 2018, 3 pages.
Written Opinion for International Application No. PCT/GB2017/053870 dated Apr. 24, 2018, 5 pages.
Japanese Office Action dated Jul. 7, 2022 for counterpart Japanese Patent Application No. JP2019555078.

* cited by examiner

APPARATUS FOR MIXING INCLUDING A LIQUID INJECTION NOZZLE

CROSS REFERENCE TO RELATED APPLICATIONS

This application is a National State Patent Application of International Application No. PCT/GB2017/053870 filed on Dec. 21, 2017, which claims the benefit of GB Patent Application No. 1622183.0 filed Dec. 23, 2016, each of which is incorporated by reference herein in its entirety.

BACKGROUND OF THE INVENTION

The invention relates to apparatus and methods for mixing the contents of a storage or containment container, and in particular to apparatus and methods for mixing a liquid and a particulate together in situ in a storage or containment container of a tumble blender.

Apparatus for mixing the contents of storage and containment devices such as IBCs (Intermediate Bulk Containers) in-situ in the container is known. It provides the advantage that the constituents of mixtures such as foodstuffs and pharmaceuticals can be mixed in-situ in the container in which they are being stored and/or transported without the need to transfer them to a separate mixer and back again, thus saving time and expense. It also removes the need for cleaning of the mixing device before processing of the next mixture can occur, also saving time. Generally, such apparatus operates by moving the container including the contents relative to a fixed support, supported for example on the ground, so that the contents move inside the container and mixing occurs. An effective form of movement can be rotation of a container such as an IBC, end over end. In the art, such processes are commonly called tumble blending.

Known tumble blending apparatus can suffer from some disadvantages in some specific uses. For example, complete mixing of some constituent types is sometimes difficult to achieve for the very reason that the apparatus is only capable of mixing by movement of the entire container, and this can be a limitation on their utility when the constituents include particulates and fats. Also, with tumble blending there can be a tendency for the tumbling action to create balls of fat-rich powder which do not become homogeneously mixed. Incomplete mixing can also occur if insufficient airspace (known as ullage) is left in the container because the space available for movement of the contents is limited.

Recently it has been suggested that problems such as these could be overcome if more conventional mixing procedures, such as for example high shear mixing, could be used in combination with tumble blending. However, a problem lies in how to successfully incorporate apparatus to achieve such procedures into a tumble blender type device, without sacrificing its many advantages or compromising its operation. Applicant's own EP 2386351A1 describes apparatus that seeks to address some of these problems.

Furthermore, it is often required to add constituents whilst mixing is proceeding, rather than before, which clearly presents some unique challenges if the container to which the constituents must be added is large and heavy and rotating at speed. Addition of liquid is particularly problematical. In EP 2386351A1, addition of liquid by spraying is described and although this works well in some circumstances, in others it can result in unblended liquid becoming smeared onto the container walls. Furthermore, the capacity for liquid addition is limited to a few litres. The present invention seeks to address problems such as these.

SUMMARY OF THE INVENTION

According to a first aspect of the invention, there is provided apparatus for mixing a particulate material with a liquid in a container adapted for tumble blending, the apparatus comprising a mixing device and a liquid injection nozzle, the mixing device including mixer elements adapted to mix a particulate material by mechanical action, characterised in that the nozzle is disposed to direct liquid in the direction of the mixer elements when mixing is taking place, there being means to prevent ingress of material into the nozzle. It has been found that the combination of directing liquid to the mixer elements with means to prevent ingress of material into the nozzle results in superior and more reliable mixing performance.

The apparatus may be disposed in a container adapted for tumble blending, such as for example in a removable closure of such a container or otherwise in a wall of a said container. It is convenient if the apparatus is disposed in a removable closure of a container as the removable closure can be substituted for the normal closure device of the container when mixing is required.

The means to prevent ingress of material into the nozzle may comprise a closure and the closure may be openable upon injection of liquid. The apparatus may include control means to trigger opening of the closure when a container including the apparatus is in a position in which the nozzle is immersed in material in the container. The control means may comprise a timer, to time opening of the closure in relation to immersion, and a sensor to sense attitude of the container to control opening.

The apparatus may include liquid storage and delivery means for storage and delivery of liquid to the nozzle. The liquid storage and delivery means may comprise a storage container and a pump. It is preferred that the liquid delivery means is adapted to enable delivery of some or all of a fixed volume of liquid. In particular, the liquid delivery means may be controlled to deliver a desired volume of liquid by measuring elapsed delivery time.

In one embodiment, the apparatus comprises one or more delay timer to prevent and/or reduce powder ingress into the nozzle. Preferably, one or more delay timer is used between operation of the pump and operation of the liquid nozzle to further prevent and/or reduce powder ingress into the nozzle. In one embodiment, there is a 0.1 second delay after the start of the pump stroke and the start of the nozzle opening, thus allowing pressure to build in the nozzle before opening. In another embodiment, there is a 0.1 second delay between closing the nozzle and the end of the pump stroke, which closes the nozzle while it is still pressurised.

In one embodiment, a pressure sensor is used to monitor the pressure in the container in case incorrect liquid addition parameters cause over-pressure in the container. Preferably, the pressure sensor is mounted in a lid of the container.

According to a second aspect of the invention there is provided a tumble blending system comprising a tumble blender and apparatus as defined hereinabove. Optionally, the system may include a container for mixing.

According to a third aspect of the invention, there is provided a method of mixing a particulate material and a liquid in a container the method comprising simultaneously rotating the container whilst mechanically mixing the contents and adding liquid, the method including the step of adding the liquid in the direction of mixer elements of the container while mixing is taking place, and operating a liquid addition device to add liquid only while the nozzle is immersed.

It is preferred that the method includes a dry blending phase before liquid addition commences.

It is preferred that the step of liquid addition is controlled by measuring container rotation time and adding liquid when rotation to an appropriate container position to ensure nozzle immersion has occurred.

BRIEF DESCRIPTION OF THE DRAWINGS

The invention will further be described by way of example, and with reference to the following figures, in which.

DETAILED DESCRIPTION

Figure 1:
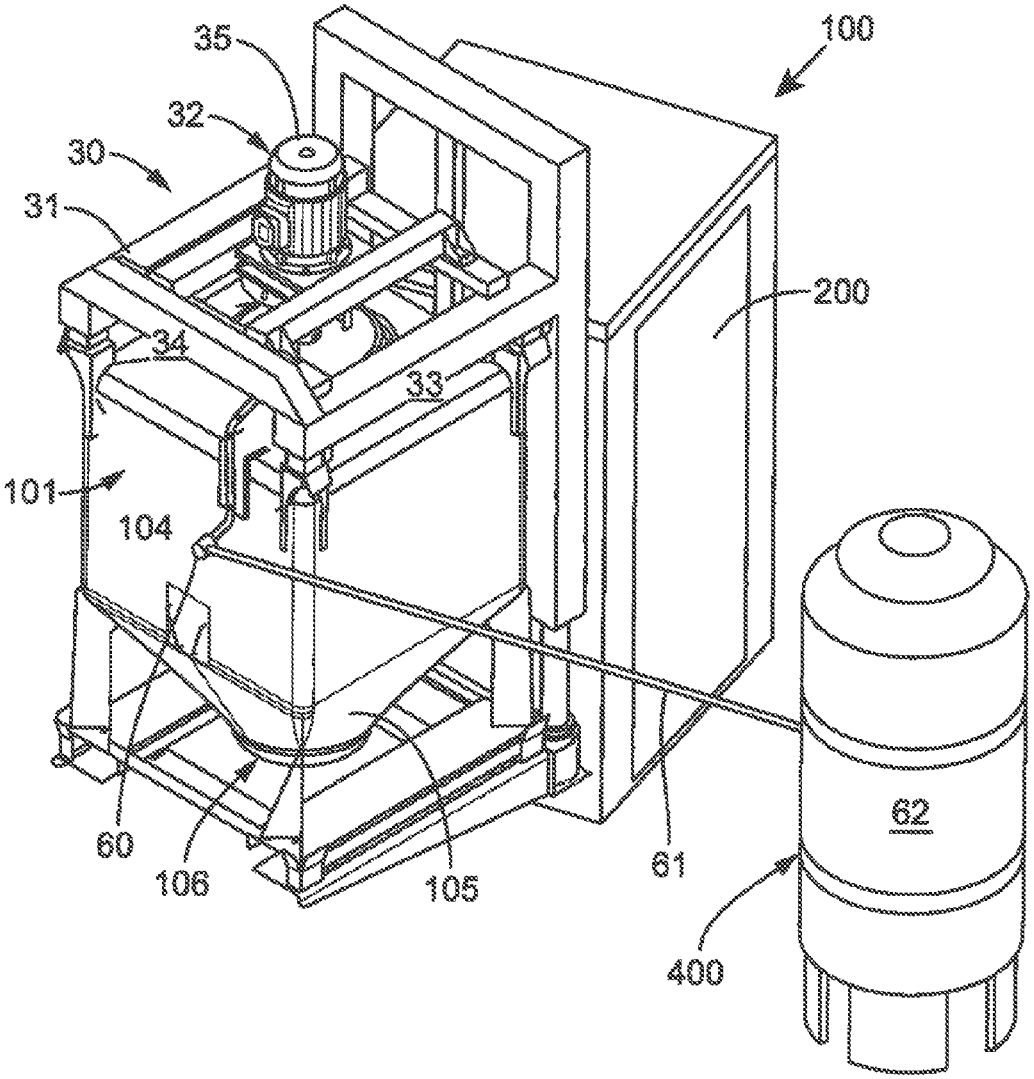
FIG. 1 is a front perspective view of a system and apparatus according to the invention.

Referring to the Figures, and in particular to FIGS. 1 to 5, there is illustrated apparatus 1 according to the invention incorporated into a tumble blending system 100. Tumble blending system 100 comprises three major parts, the major parts being a tumble blender 200, an IBC (intermediate bulk container) 101 and a liquid addition module 400. In this embodiment apparatus 1 according to the invention takes the form of a closure for the IBC, the closure comprising a mixing device 2 and a liquid injection nozzle 3, the mixing device 2 including mixer elements 4 adapted to mix a particulate material by mechanical action. Nozzle 3 is disposed to direct liquid in the direction of the mixer elements 4 when mixing is taking place, there being means 5 to prevent ingress of material into the nozzle.

As will be appreciated, system 100 is used for blending contents contained in the storage or transport container 101 in-situ in the container. FIG. 1 shows a container 101 of a known configuration, referred to as an Intermediate Bulk Container, or IBC. The IBC is shown in place on blender 200 in order to illustrate the functioning of the apparatus 1. The IBC has an inlet 102 located on a top surface 103, a square section main body part 104 and a lower section 105 in the form of an inverted truncated pyramid. An outlet 106 is located at the bottom, as viewed, of the lower section 105. The top of the IBC is normally obturated by a simple lid closure (not shown) and the outlet 106 is obturated by a conical valve 108 that can be raised into the lower section 105 to allow mass flow out of the container. The IBC also includes top and bottom stacking features, 109, 110.

FIG. 1 shows the IBC clamped, ready for blending. Blending takes place by tumbling the IBC end over end, on an asymmetric axis, causing the contents to flow over each other. An operator panel (not shown) is provided to include controls for Start, Stop, Clamp, Unclamp, Reset and E-Stop, with Cycle Time and Rotating Speed displays as well as a Status lamp.

Blender 200 includes a top assembly 30. The top assembly 30 consists of a base 31 and a mixer drive assembly 32 and is mounted to upper frame side bars 33, effectively covering the gap between the side bars 33 and cross-piece 34. The top assembly 30 is thus placed such that it is above an IBC 101 when the IBC is in place in the blender 200. The mixer drive assembly 32 comprises a motor 35 of generally known type.

Referring now to FIGS. 2 to 5, as previously mentioned it can be seen that apparatus 1 according to the invention is disposed in a lid to be applied to inlet 102 of the container, although, as will be appreciated, this is not essential. The apparatus 1 as described could be disposed in a wall of a container, for example. The lid comprises a circular plate 24 dimensioned to fit within and seal with the inlet aperture 102 of the container 101 containing contents to be mixed. The plate 24 has a depending flange (not shown) that includes a deformable sealing ring of known type. The centre of the plate 24 is formed with an aperture into which is welded a tube 25 including bearings and a mixer shaft 27 mounted for rotation thereon. At its top (as viewed) the mixer shaft 27 terminates in drive coupling 28. Drive coupling 28 includes two driving lugs 26 that extend opposite one another and laterally with respect to the axis of rotation of the mixer shaft 27 from the circumference of the shaft so that in section the shaft has the appearance of a "T". At its bottom (as viewed) end the shaft 27 is provided with a plurality of mixer elements 4 which here take the form of blades.

Figure 6:
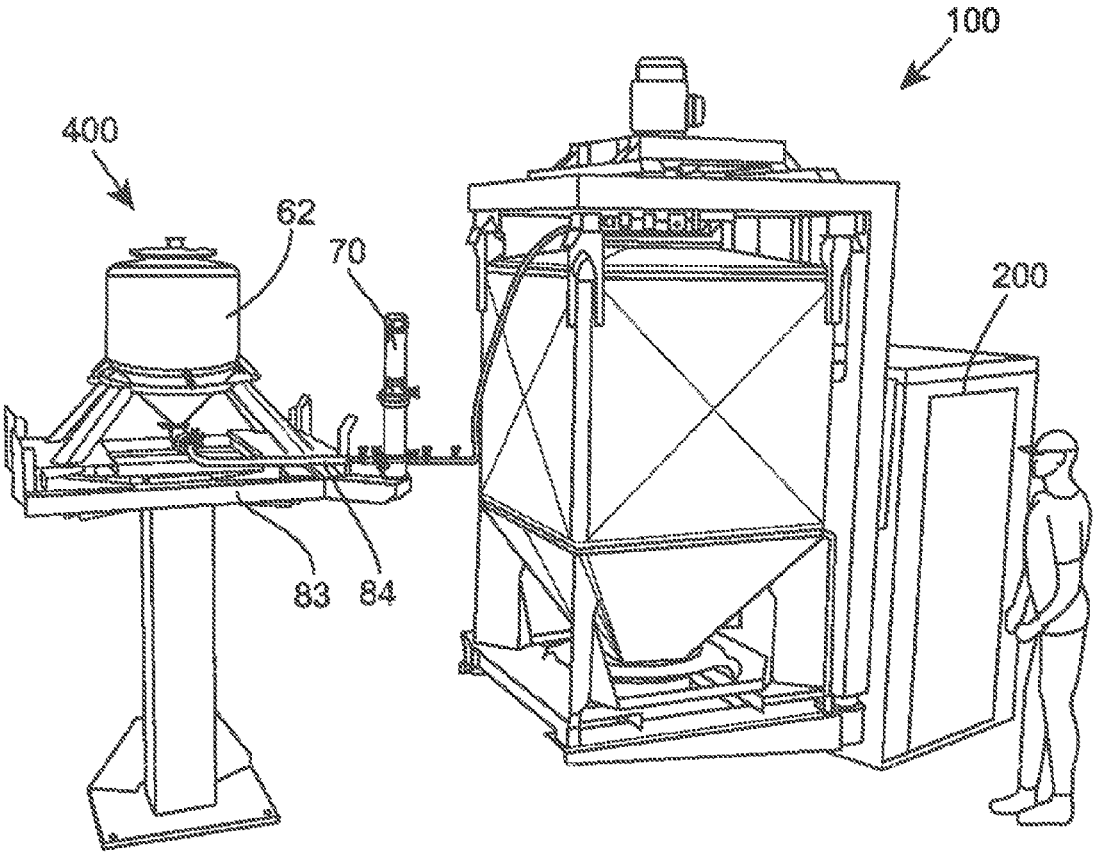
FIG. 6 is a side perspective view of a system and apparatus according to the invention.
Figure 7:
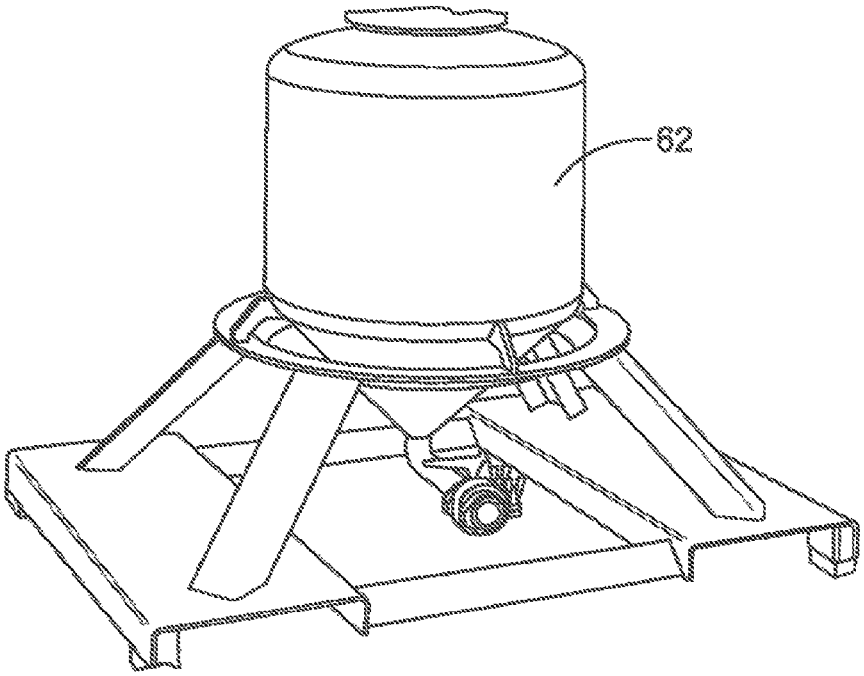
FIG. 7 is a perspective view of a part of the system of FIG. 6.

The plate 24 is provided with a manually operable pressure release valve 36 and liquid injection nozzle 3 with liquid inlet pipe 37 attached to a pump 70 (FIG. 6).

Figure 3:
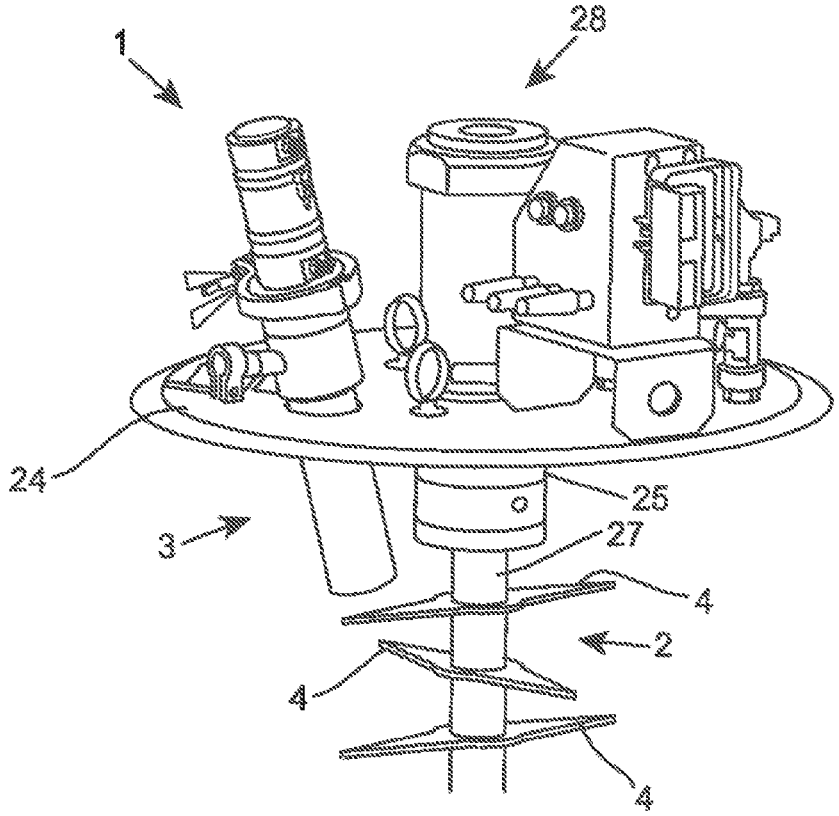
FIG. 3 is a side view of the part shown in FIG. 2.
Figure 4:
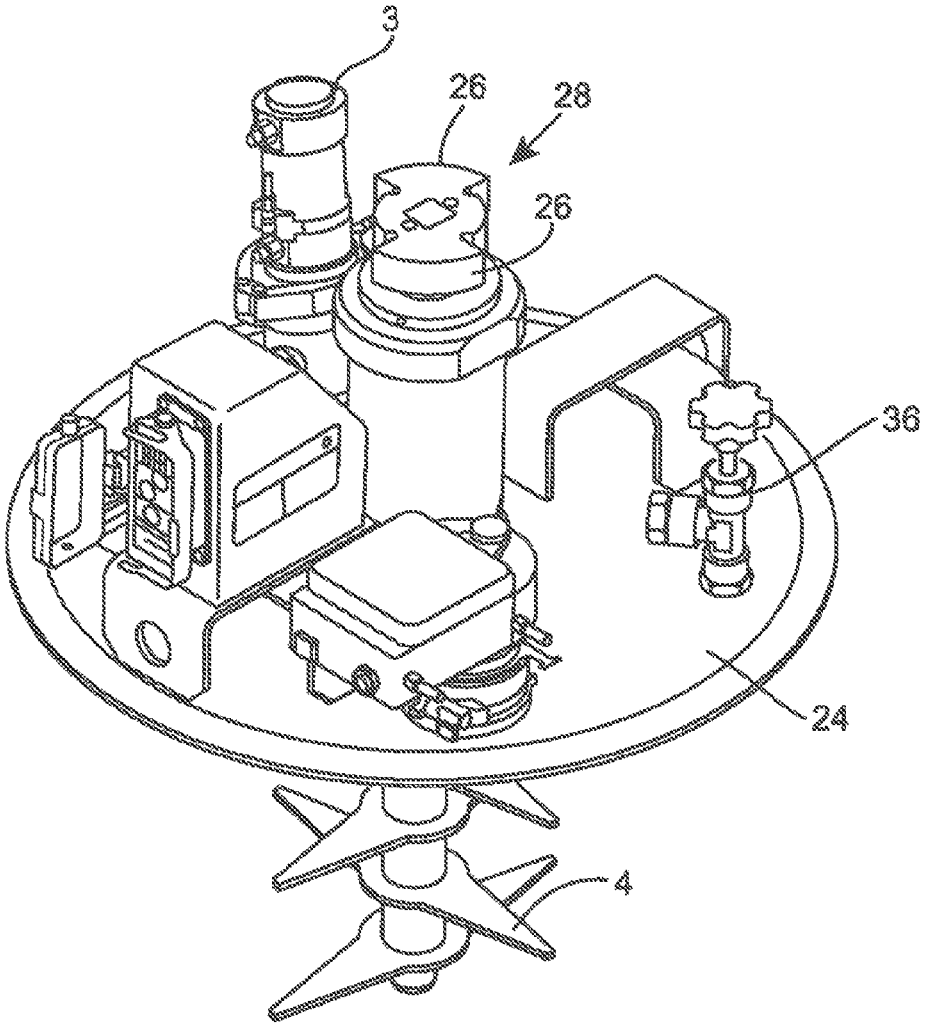
FIG. 4 is a top perspective view of the part shown in FIG. 2.
Figure 5:
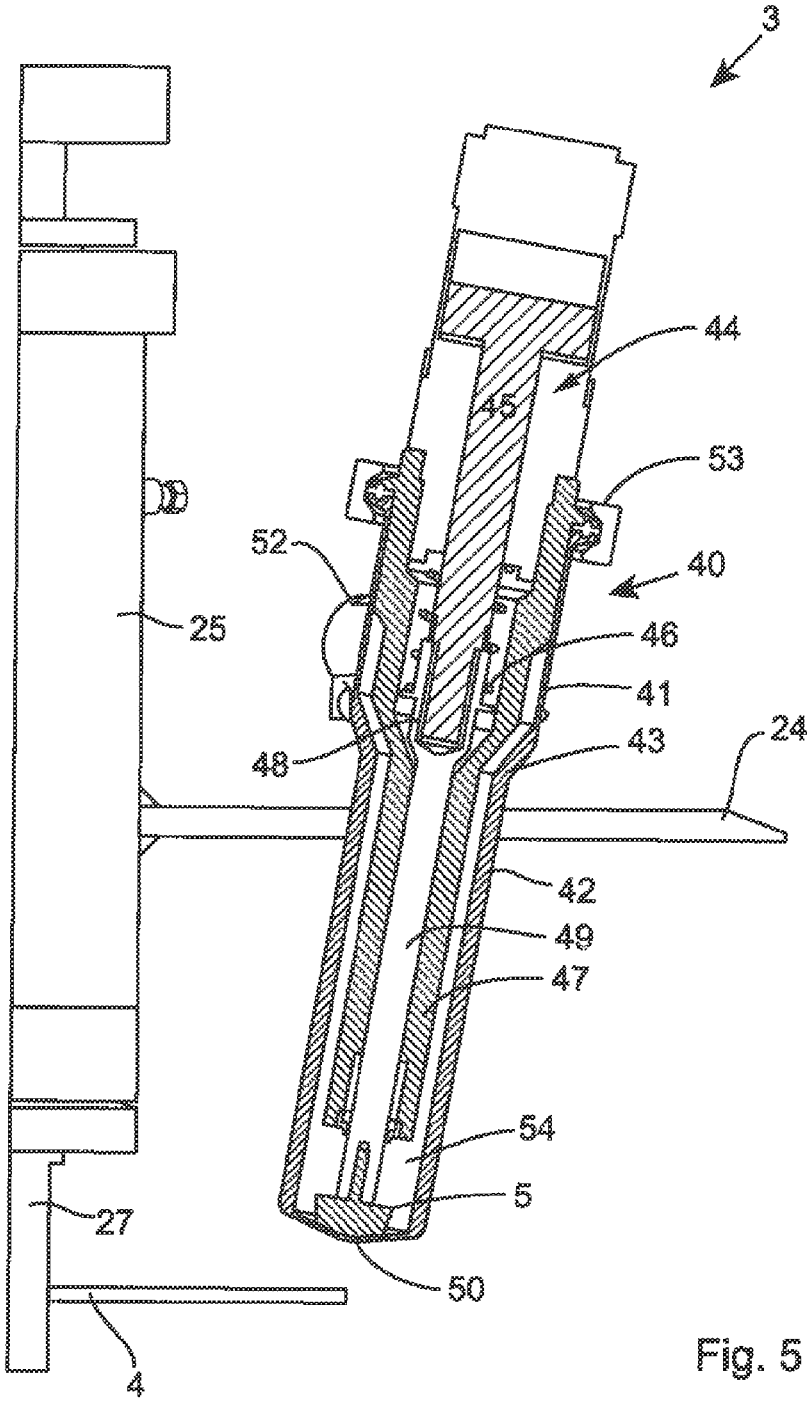
FIG. 5 is a longitudinal sectional view of a nozzle assembly of the part of FIG. 3.

Referring now to FIG. 5, liquid injection nozzle 3 is illustrated in longitudinal section. The nozzle 3 comprises a cylindrical housing 40 that has upper and lower body sections (as viewed) 41, 42, joined by a tapering waist 43, the upper section 41 having a larger diameter than the lower section 42. Upper body section 41 defines a liquid inlet 52 and houses a double acting pneumatic actuator 44 that includes piston 45 and closing spring 46 mounted for linear reciprocating movement within a guide tube 47. Guide tube 47 extends from a clamped sealing interface 53 with upper body section 41 into lower body section 42, thereby defining a liquid delivery tube and chamber 54. Lower body section 42 includes a valve rod 49 within the lower part of guide tube 47. At its lower (as viewed) end, piston 45 is received within a blind threaded bore 48 formed in the upper (as viewed) end of valve rod 49, and valve rod 49 extends down through guide tube 47, beyond its lowest extent to a nozzle orifice 50 formed in the distal end of lower body section 42. Means to prevent ingress of material in the form of a valve stopper 5 is located at the distal end of valve rod 49, the valve stopper 5 seating on the internal surface of the distal end of lower body section 42. Referring in particular to FIGS. 3 and 5, it can be seen that liquid injection nozzle 3 is mounted through an aperture in plate 24 and is inclined relative thereto, such that the lower body section 42 and therefore nozzle orifice 50 is directed towards mixer elements 4.

Figure 2:
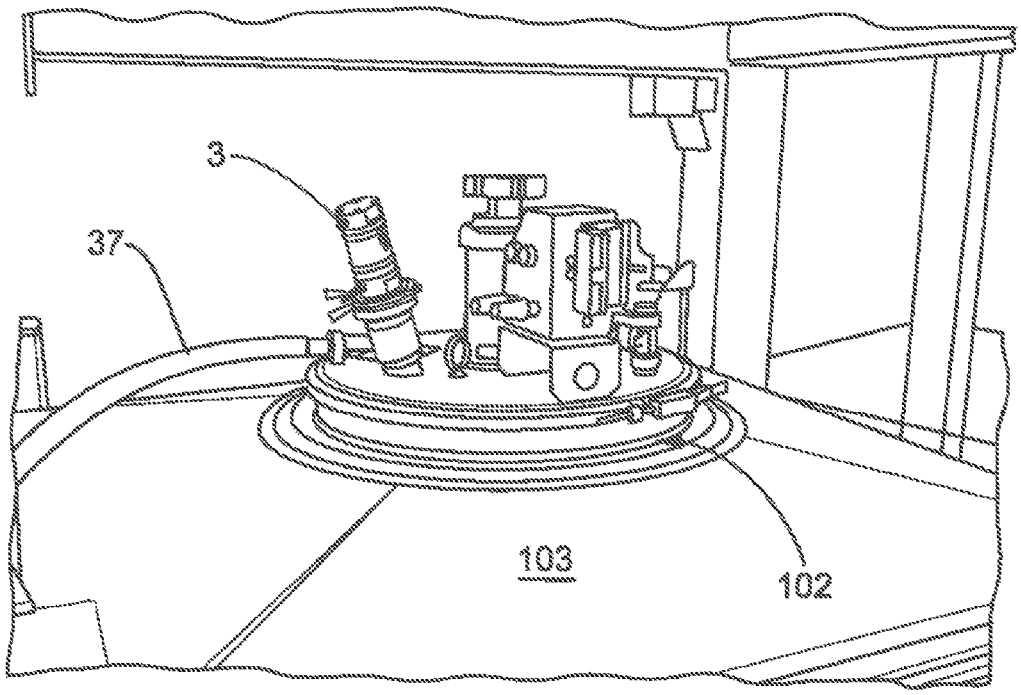
FIG. 2 is an enlarged, perspective view of a part of the apparatus of FIG. 1.

Referring now to FIGS. 1 and 2, a first embodiment of liquid addition apparatus is illustrated. it can be seen that liquid inlet pipe 37 attaches at its distal end to liquid inlet 52 of liquid injection nozzle 3, and at its proximal end, via rotary joint 60, to liquid supply pipe 61. Pipe 37 is mounted for rotation via rotary joint 60. Liquid supply pipe 61 is attached at its proximal end to a pneumatic pump (not shown) and a liquid supply tank 62 (shown schematically).

Figure 9:
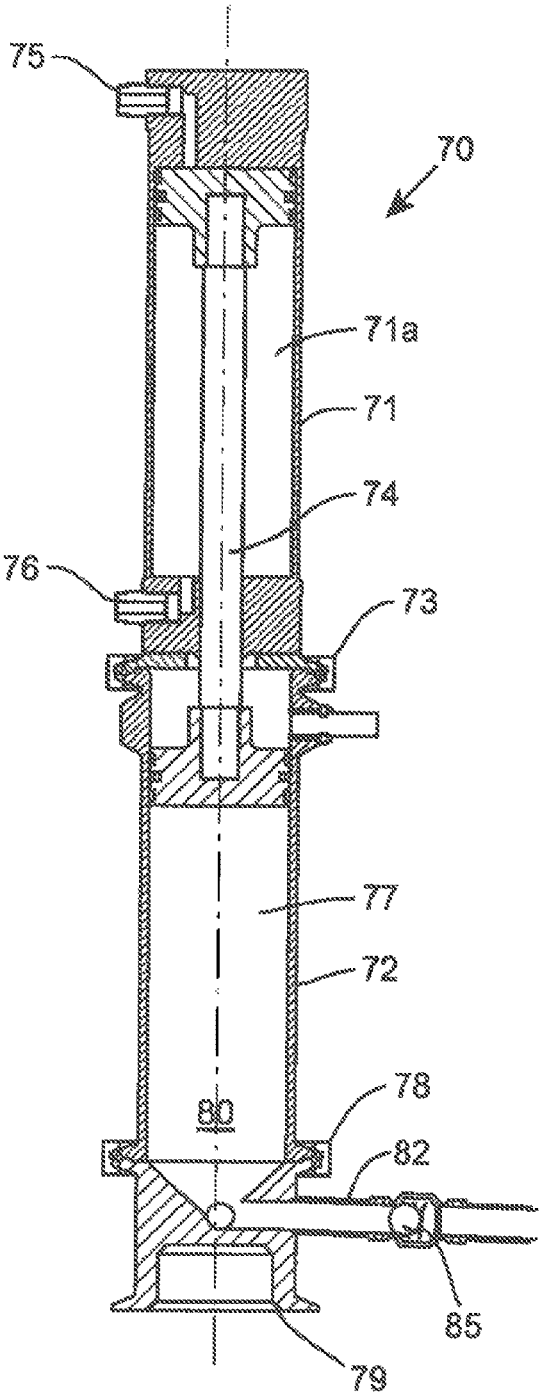
FIG. 9 is a longitudinal sectional view of the part shown in FIG. 8.
Figure 8:
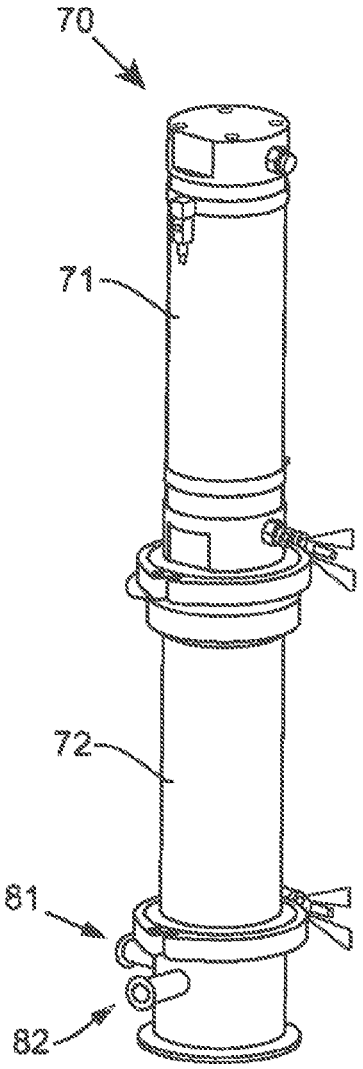
FIG. 8 is a perspective view of a further part of the system of FIG. 6.

Referring now to FIGS. 6 to 9, a second embodiment of liquid addition apparatus is illustrated. FIGS. 6, 8 and 9 show detail of liquid supply pump 70, which comprises upper and lower (as viewed) cylindrical housing sections 71, 72 joined by clamp joint 73. Upper housing section 71 defines bore 71*a* in which piston 74 is mounted for linear reciprocating movement, and upper and lower (as viewed) air inlets, 75, 76. As will be appreciated, upper housing section 71 therefore forms a pneumatic actuator. Piston 74 extends downwardly (as viewed) from upper housing section 71 into lower bore 77 defined within lower housing section 72. Lower housing section 72 attaches via clamp joint 78 at its lowest extent to mounting/locator assembly 79, and together these parts define liquid delivery chamber 80 (which in this example has a nominal 1 litre volume), including liquid inlet and outlet ports 81,82 which both include non-return valves 85. Referring now to FIG. 6, liquid supply pump 70 is shown in place in a system 100. This figure illustrates in detail the connection and relative dispositions of liquid supply tank 62, and liquid supply pump 70, both of which are mounted upon support frame 83 and are connected via liquid supply conduit 84.

By way of example only, and to illustrate in a non-limiting way the aspect of the invention that lies in the method of operation, particulate ingredients such as a powder are loaded into an IBC 101 according to the required recipe. A lid with mixer elements 4 and a liquid nozzle 3 is fitted to IBC inlet. The IBC is loaded into the blender and the required amount of liquid is loaded into the liquid supply tank 62 which is then loaded onto support frame 83. The required liquid supply pipe connections are made (pipe between tank and pump, pipe between pump and IBC, electro/pneumatic umbilical between lid and blender) and the operator exits the blender room, closing and interlocking door. The operator selects "blend recipe" from a menu in the control system which will dictate the following

- Total blend time (e.g. 20 minutes)
- Blend rotation speed (e.g. 10 rpm)
- Intensifier speed (e.g. 1500 rpm)
- Dry blend time (before start of liquid addition, e.g. 5 minutes)
- Liquid inject times
- Inject delay time
- Inject time per rotation
- Total liquid addition time The blend cycle starts by raising the loaded IBC to its clamped position. Blend rotation of the IBC is initiated, followed by start of rotation of mixer elements 4. As will be appreciated, at this point liquid addition has not yet begun, and this dry blend phase allows homogeneity of dry ingredients to be achieved before the start of liquid addition. At the start of liquid addition the IBC is moving at approximately 10 rpm rotation speed. By selecting an appropriate liquid inject delay time the operator can ensure that liquid addition only starts when nozzle 3 is immersed in powder. Ensuring that the nozzle is immersed during liquid addition has been found to aid in achieving successful mixing of liquids and solid particulates such as powders. The inject time per rotation controls the length of time pump 70 is pumping so that it achieves some or all of its pump stroke, thereby some or all of the 1 litre volume is injected. During the pump stroke the liquid piston 74 is driven downwards, sending liquid through the outlet non-return valve 82, 85 and closing the inlet non-return valve 81, 85. At the end of inject time the pump 70 retracts, drawing liquid from the tank 62 through the inlet non-return valve 81,85, closing the outlet non-return valve 82, 85. During initial rotations, air will be pumped until liquid fills the pump 70 and pipe system. Likewise, at the end of liquid addition, air will be pumped while all remains of liquid are purged from the pipe system. The total liquid addition time is therefore established long enough to ensure the full volume of liquid is added. After completion of the liquid addition phase, blend rotation continues for the remainder of the total blend time which can assist in ensuring that the liquid is fully homogenised throughout the powder volume, although this isn't always necessary. At the end of the blend cycle the IBC 101 is unclamped, the operator enters the blender room and disconnects pipes and umbilical, and removes the IBC from blender.

The apparatus may comprise one or more delay timers between operation of the pump and operation of the liquid nozzle to further prevent and/or reduce powder ingress into the nozzle. In one embodiment, there is a 0.1 second delay after the start of the pump stroke and the start of the nozzle opening, thus allowing pressure to build in the nozzle before opening. In another embodiment, there is a 0.1 second delay between closing the nozzle and the end of the pump stroke, which closes the nozzle while it is still pressurised.

A pressure sensor may be mounted in the intensifier lid 24, wherein the pressure sensor may be used to monitor pressure in the IBC 101 in case incorrect liquid addition parameters cause over-pressure in the IBC.

Figure 10:
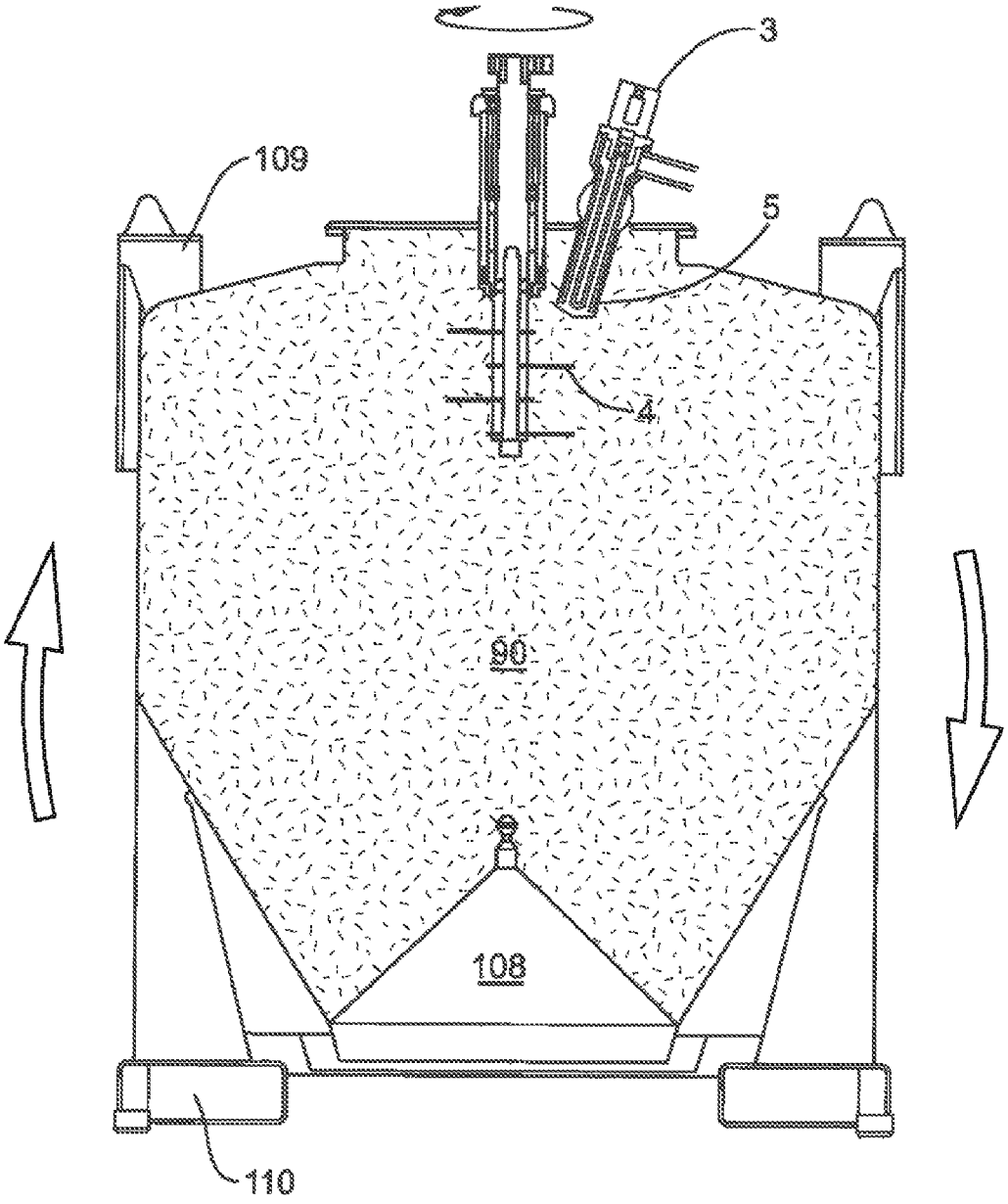
FIGS. 10 and 11 are schematic views of apparatus according to the invention in operation.
Figure 11:
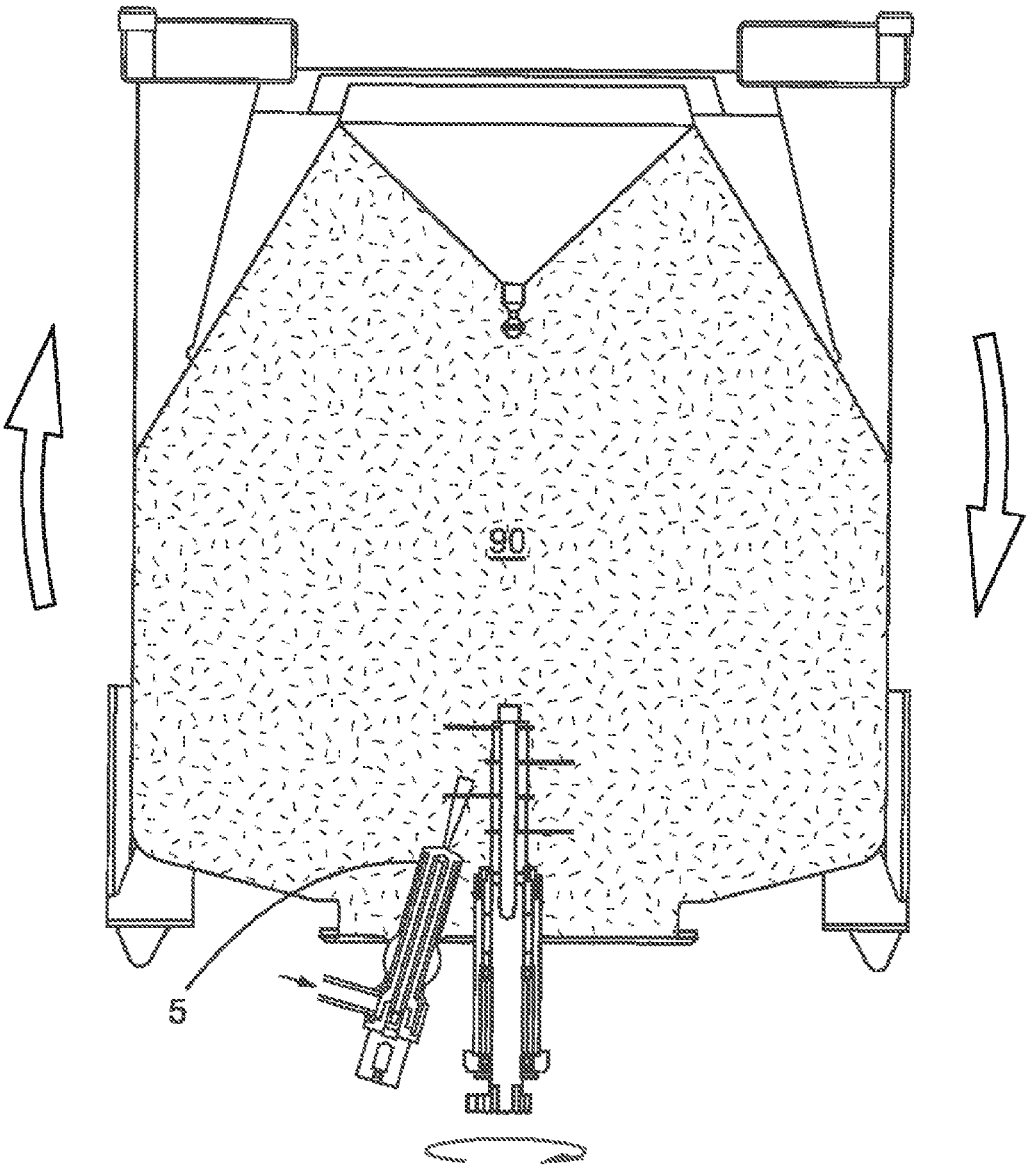

FIGS. 10 and 11 show schematically apparatus 1 according to the invention, in operation, mounted in the lid of an IBC. In FIG. 10, the IBC is shown at the phase of rotation in which it is substantially upright relative to the ground. The mixer elements 4 are rotating but the liquid injection nozzle 3 is not immersed in the material 90 in the container 101. As such, the orifice 50 of the liquid injection nozzle 3 is closed by stopper 5 under force of pneumatic actuator 44. In FIG. 11, the IBC is shown at the phase of rotation in which it is substantially inverted. The mixer elements 4 are still rotating and mixing the material 90 in which they are now fully immersed. As the liquid injection nozzle 3 is itself also immersed in the material 90, liquid is fed by pump 70 to liquid injection nozzle 3, and the pneumatic actuator 44 in the upper body section 41 draws the valve rod 49 and valve stopper 5 upwards, opening the orifice 50 and allowing liquid to flow into the material 90.

The invention claimed is:

1. An apparatus for mixing a particulate material with a liquid in a container adapted for tumble blending, the apparatus comprising:

a mixing device;

a liquid injection nozzle, the mixing device including mixer elements adapted to mix a particulate material by mechanical action; and a control system including a menu adapted to allow an operator to select a blend recipe, wherein the liquid injection nozzle is disposed to direct liquid in the direction of the mixer elements when mixing is taking place, there being means for preventing ingress of material into the liquid injection nozzle, wherein the means for preventing an ingress of material into the liquid injection nozzle comprises a closure of an outlet of the liquid injection nozzle, the apparatus further including a means for triggering opening of the closure when a container including the apparatus is in a position in which the liquid injection nozzle is immersed in material in the container, and wherein the menu dictates total blend time, blend rotation speed, intensifier speed, dry blend time, liquid inject times, inject delay time, inject time per rotation, and total liquid addition time.

2. The apparatus according to claim 1, further including a container configured for tumble blending.

3. The apparatus according to claim 2, wherein the apparatus for mixing is disposed in a removable closure or in a wall of the container suitable for tumble blending.

4. The apparatus according to claim 1, wherein the closure is reciprocated between open and closed positions by an actuator.

5. The apparatus according to claim 1, wherein the closure is openable by ejection of liquid from the liquid injection nozzle.

6. The apparatus according to claim 1, wherein the means for triggering the opening of the closure comprises a timer to time opening of the closure in relation to immersion, and a sensor to sense attitude of the container to control opening.

7. The apparatus according to claim 1, further including a means for storing and delivering a liquid to the liquid injection nozzle.

8. The apparatus according to claim 7, wherein the means for storing and delivering a liquid comprises a storage container and a pump adapted to enable delivery of some or all of a fixed volume of liquid.

9. The apparatus according to claim 8, wherein the means for storing and delivering a liquid is controlled to deliver a desired volume of liquid by measuring elapsed delivery time.

10. The apparatus according to claim 1, wherein a container outlet is obturated by a conical valve.

* * * * *